United States Patent [19]

Outlaw

[11] Patent Number: 4,966,321

[45] Date of Patent: Oct. 30, 1990

[54] ADJUSTABLE HOLSTER FOR PISTOL TYPE POWER TOOLS

[76] Inventor: Wade S. Outlaw, 2633A Wyoming St., St. Louis, Mo. 63118

[21] Appl. No.: 376,366

[22] Filed: Jul. 6, 1989

[51] Int. Cl.[5] ..... A45F 5/00

[52] U.S. Cl. ..... 224/253; 224/901; 224/911; 224/904

[58] Field of Search ..... 224/253, 901, 911, 912, 224/243, 244, 242, 904

[56] References Cited

U.S. PATENT DOCUMENTS

| | | | |
|---|---|---|---|
| 2,408,678 | 10/1946 | Paley | 224/911 |
| 3,008,617 | 11/1961 | Villwock | 224/243 |
| 3,645,428 | 2/1972 | Angell | 224/253 |
| 3,923,214 | 12/1985 | Kippen . | |
| 4,205,768 | 6/1980 | Hill et al. | 224/193 |
| 4,258,871 | 3/1981 | McMahon | 224/192 |
| 4,312,466 | 1/1987 | Clark | 224/243 |
| 4,544,089 | 10/1985 | Tabler | 224/192 |
| 4,645,103 | 2/1987 | Bianchi et al. | 224/243 |
| 4,718,585 | 1/1988 | Atkins, Sr. | 224/911 |

*Primary Examiner*—Linda J. Sholl

[57] ABSTRACT

This invention is a universally adjustable holster that accommodates a wide variety of pistol shaped objects both conventionally and unconventionally shaped, including pistol type objects that enlarge from the trigger area to the use end. Two adjustable straps 4 and 5 along the vertical length of the holster pocket allow for the secure holstering of power drills, screwguns, and other pistol type objects. This holster can be produced with qualities of excellent strength and durablity at an extremely low cost. The condition of this holster when not in use is flat.

3 Claims, 2 Drawing Sheets

ADJUSTABLE HOLSTER FOR PISTOL TYPE POWER TOOLS

BACKGROUND OF INVENTION

This invention relates to the use of a universally adjustable, hip mounted holster for pistol type power tools and similarly shaped objects.

This holster easily and securely holds a wide variety of shapes now utilized in the manufacture of drills, portable drills, screwguns, and portable screwguns. Two locations on the holster allow for proper adjustment to pistol type objects through the use of hook and pile material commonly known as "Velcro".

Holsters currently available are shaped to accommodate pistol shaped objects that narrow in size in approach towards the tip or use end. This holster not only accommodates such traditionally shaped pistol type objects, but also accommodates pistol shaped objects which widen in approach towards its tip or use end.

Most currently available holsters are designed to accommodate a particular pistol shaped object or a class of pistol shaped objects of approximately the same size and balance point as it hangs in a pouch on a loop wrapped around a belt. This holster is designed with an extra wide double loop arrangement that allows for the proper balancing of pistol type objects with radically different shapes, weights, and handles; from short and light to long and heavy. Many rechargable power tools contain battery packs within an extended heavy handle.

Two methods of affixing hip holsters to users belts prevail in the current state of art. One method utilizes a single loop, either fixed or with detachable fasteners on one end, through which the users belt passes. The other method employs slots in a piece of sheet material, most often leather, through which a belt passes thereby compressing a portion of the sheet material against the users body.

While both methods keep the holster somewhat stationary along the users belt line, neither method forces the holster to stay in the originally placed position.

The holster herein submitted employs a double loop method. By trapping or leaving free the users pants belt loop between holster loops, the user has an option as to a fixed or mobil location of holster along belt line. This arrangement represents an improvement in ability to affix the holster in a single location as the users pants belt loop would have to giveway before the holster would shift.

Other holsters with adjustable features have utilized the advantages of "Velcro". Referring now to U.S. Pat. No. 4,645,103, "Velcro" was incorporated to allow for adjustment in both the holster belt loop and weapon hold down strap. Neither of these adjustments have an affect on the size of the holster pocket. My invention allows for two or more adjustments along the vertical length of the holster pocket to accommodate a hitherto unrealized versatility in size and shape of pistol type object to be holstered.

Another holster, U.S. Pat. No. 4,312,466 is both adjustable and utilizes "Velcro". Its adjustability is limited to increased resistance to undesirable movement of holster safety strap.

Adjustable holster, U.S. Pat. No. 4,544,089 is adjustable in that it creates a belt width of tension across the center of weight of a variety of pistol type weapons as its tip or muzzel end points generally downward. The holster proposed in this application creates a continuously adjustable pocket. This pocket is approximately an elliptical cone and may be adjusted so that either end of the cone may be larger in circumference.

The design of this holster, combined with the synthetic materials of preferred embodiment allow for the production of an extremely strong, tear resistant, easily cleaned, no-rot, nonabsorbent holster. Additionally, this holster folds flat while not in use for easy storage and efficient use of tool storage space.

The owner of holster herein described may own numerous and varied pistol type power tools and other such objects and holster them all with this one apparatus.

OBJECTS AND ADVANTAGES

Accordingly the objects and advantages of my invention are numerous. This holster accommodates an exceptionally diverse variety of pistol type objects with a wide range of weights, shapes, sizes and centers of balance. The "Velcro" style adjustable straps employed here are easy to operate, affix in a secure manner and are part of a design which permits continuous adjustment along the vertical length of the holster pocket, thereby controlling the size of the generally elliptical cone that constitutes said pocket.

Both conventionally shaped pistol type objects which narrow in approach towards use end and unconventionally shaped pistols which widen in approach towards use end may be securely holstered.

Three simultaneous advantages of the extra wide double loop arrangement employed here are apparent. This extra wide double loop serves to balance the weight of pistol type objects with unconventionally long, heavy handles.

Secondly, the width of these loops taken together, when forced against the users waist by a belt, serve, in conjunction with a boning material entrapped in the upper seam of the holster sheet material, to constantly create an oval like opening at any given point along the adjustability range of the upper adjustable strap that is advantageous to easy pistol insertion.

Lastly, the double loop allows the user a choice between trapping users pants belt loop between holster belt loops, thus giving the holster a fixed location along the users belt line, or leaving the users belt loop free, thus allowing the holster to be shifted along users belt line at will.

This holster allows the owner to have and to holster a wide variety of pistol type objects without obtaining a seperate holster for each pistol, without the additional expense of additional holsters, and without the annoyance and waste of time incurred when shifting from the use of one power tool to another when utilizing more traditional holsters.

While not in use, this holster folds flat for easy and efficient storage.

The preferred embodiment of this invention results in numerous advantageous characteristics. The synthetic materials preferred are rot free, non-absorbent, have great strength, durability, tear resistance and are very inexpensive.

DETAILED DESCRIPTION OF THE INVENTION

Figure 1:
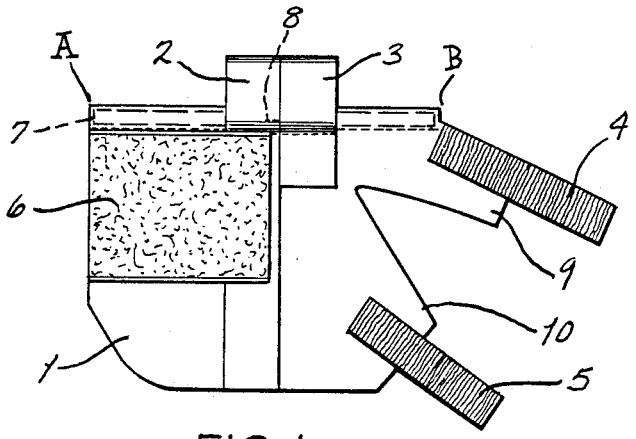
FIG. 1 is a flat view of the outside surface of the holster; the outside surface being that surface which remains visible once a pistol type object is secured in the holster.

Referring now to component 1 as shown in FIG. 1, this material is flexible sheet material. The preferred embodiment of this component is vinyl nylon laminate as is commonly used in awning and tarp construction though other materials may be used. The preferred embodiment material is inexpensive and extremely resistant to tear. Sheet material utilized shall be cut to size appropriate for the range of adjustability desired to holster pistol type objects in a particular class of size.

The upper seam of this sheet material is folded down towards the inside of the holster and sewn or otherwise affixed, in such a manner as to entrap a band of boning material commonly used to retain the shape of collars in womens clothing, or other such material with the properties of shape retention and flexibility. The inside surface of the holster is that surface depicted in FIG. 2. The entrapment of boning material within the top seam is easily viewed in FIG. 3.

The boning material is sewn, or otherwise affixed, to both sides of the entrapping sheet material in one location 8 approximately at the center of the length of boning as is seen in FIG. 1.

The belt loops of this holster 2 and 3 are a flexible webbing material. The preferred embodiment of this component is nylon webbing. Nylon webbing has great strength, durability and resists damage from the level and quality of friction encountered on a belt loop, though other webbing material may be used.

These belt loops adjoin in placement on the sheet material at a point approximately in the center of the total length of the top seam; that distance being the same as the length of boning.

Belt loop webbing 2 is sewn, sewn and glued, or otherwise affixed, to sheet material at approximately a right angle to the top seam entrapping boning.

Belt loop webbing 2 covers an area on and above the sheet material from approximately the bottom edge of the holster to a point sufficiently above the top seam so as to allow for the width of belts that would be expected to hold a holster, whereupon, a 180 degree turn in the direction of the material is made. Said loop webbing extends down the inside surface of the sheet material to a point sufficiently below the top seam so as to allow for adequate attachment to sheet material.

Belt loop webbing 3 adjoins, or approximately adjoins, belt loop webbing 2 in placement on sheet material. Loop webbing 3 covers an area on and above the sheet material from a point on the outside surface of the sheet material sufficiently below the top seam so as to allow for adequate attachment to sheet material, to a point sufficiently above the top seam so as to allow for the width of belts that would be expected to hold a holster, whereupon a 180 degree turn in the direction of the webbing is made. Said loop webbing extends down the inside surface of the sheet material to a point sufficiently below the top seam so as to allow for adequate attachment to sheet material.

Referring now to component 6 as shown in FIG. 1; this material is pile fabric commonly known as "Velcro". This fabric is sewn, sewn and glued, or otherwise affixed to the sheet material from the vertical edge adjoining point A, as seen in FIG. 1, horizontally to a point approximately to the inside edge of belt loop webbing 2. The vertical area covered by this fabric extends from a point just below the top seam to a point slightly more than half the distance from the bottom of the top seam to the bottom of the sheet material.

Referring now to component 4 as shown in FIG. 1; this material is narrow webbing serving here as part of the upper adjustable strap. The preferred embodiment of this component is nylon webbing. However, other webbing or strapping material may be used.

This upper adjustable strap webbing is sewn, sewn and glued, or otherwise affixed to the sheet material along the upper edge of the upper adjustment flap 9 and extends beyond the sheet material of said flap a distance adequate to allow the hook material on the inside surface of the adjustable strap, to hold the strap in place while retaining a pistol type object. This strap is placed at approximately a 25 degree angle to the top seam entrapping the boning. Other angles may be used.

Referring now to component 5 as shown in FIG. 1; this material is also narrow webbing, serving here as part of the lower adjustable strap. The preferred embodiment of this component is narrow nylon webbing. Other webbing or strapping material may be used.

The lower adjustable strap webbing 5 is sewn, sewn and glued, or otherwise affixed to the sheet material in the center of the lower adjustment flap 10 and is approximately parallel to the upper adjustable strap. This strap extends beyond the sheet material of the lower adjustment flap a distance adequate to allow the hook material on the inside surface of the strap to hold the strap in place while retaining a pistol type object.

Figure 2:
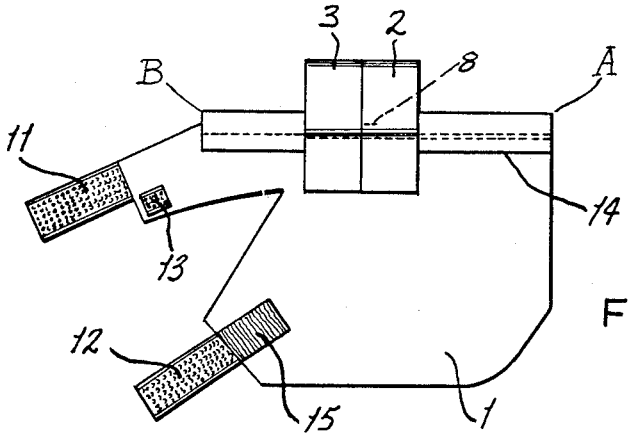
FIG. 2 is a flat view of the inside surface of the holster; the inside surface being that surface which is not generally visible once a pistol type object is secured in holster.
Figure 3:
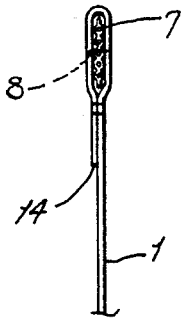
FIG. 3 is a side evaluation view of the top seam of the holster demonstrating boning material affixed within the top seam. The top seam is depicted in FIG. 2 as running from point A to point B.

Referring now to component 11 as seen in FIG. 2; this material is hook fabric and is sewn, sewn and glued, or otherwise affixed, to that portion of upper adjustable strap 4 that extends beyond the sheet material and faces the inside of the holster.

Referring now to component 13, as seen in FIG. 2; this material is hook fabric material and is sewn, sewn and glued, or otherwise affixed to the lower inside portion of the upper adjustment flap 9, approximately at the end of the flap.

Referring now to component 12, as seen in FIG. 2; this material is hook fabric and is sewn, sewn and glued, or otherwise affixed, to that portion of the lower adjustable strap 5 that extends beyond the sheet material and faces the inside of the holster.

Referring now to component 15, as seen in FIG. 2; this material is nylon webbing, or other similar material, and is sewn, sewn and glued, or otherwise affixed to both sheet material and lower adjustable strap 5 so as to provide reinforcement to said strap.

USE OF HOLSTER

The double belt loop feature incorporated in this holster allows the user to either trap a belt loop of pants worn during use of holster, between belt loops of holster, thus giving the holster a fixed location along the users waist or to leave the users pants loop free of holster belt loops, thus allowing the holster to shift along users waist line at will.

The holster is hung from the users belt with the adjustable straps extending towards the back of the users body. At this time the holster is in a flattened condition. The surface facing away from the users body is the surface viewed in FIG. 2 and is referred to in this text as the inside surface.

The user then places desired pistol type object against the central portion of sheet material with the tip or use end of the object pointing in a downward direction. The user then folds the foward extending portion of sheet material, with pile fabric 6 affixed, around the housing of the pistol and holds said sheet material in place with their hand from the opposite side of their body than the holster is mounted.

User then, with their free hand, wraps upper adjustable strap 4 around the pistol and forces the hook fabric on said strap against the upper portion of pile fabric 6 approximately parallel to the upper edge of pile fabric. Said strap is placed in such a manner as to loosely conform to the shape of the outside surface of the trigger area of the pistol so as to allow for ease of pistol removal and insertion.

User then wraps lower adjustment flap 10 around the lower housing of pistol type object in such a snug manner as to conform to the peculiar shape of said pistol and forces the hook fabric of lower adjustable strap 5 against pile fabric 6.

Figure 4:
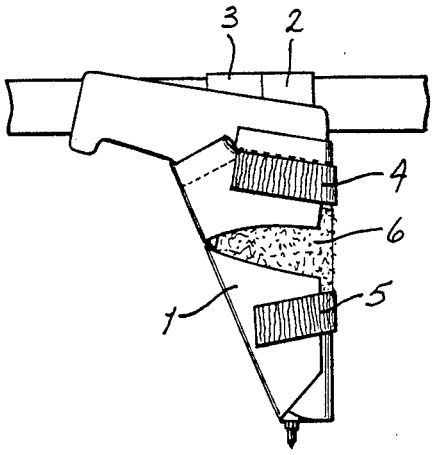
FIG. 4 is a view of holster hanging from wearer's belt, holding a small, portable screwgun.

FIG. 4 demonstrates the holstering of a small, portable screwgun. The housing of this gun progressively widens from its trigger area to the end of the housing whereupon a narrow driver protrudes from the housing. The lower adjustment flap 10 is properly placed to securely holster this unconventionally shaped pistol type object.

Figure 5:
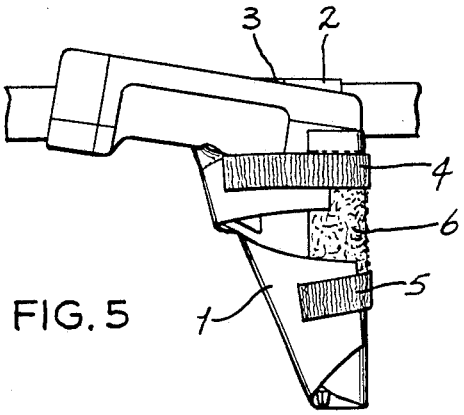
FIG. 5 is a view of the holster hanging from wearer's belt, holding a large, portable drill with a long handle.

FIG. 5 demonstrates clearly the holstering of a long, heavy handled portable drill. The holster pocket is here set to accommodate a drill housing that narrows in stages approaching the chuck end of the drill.

Figure 6:
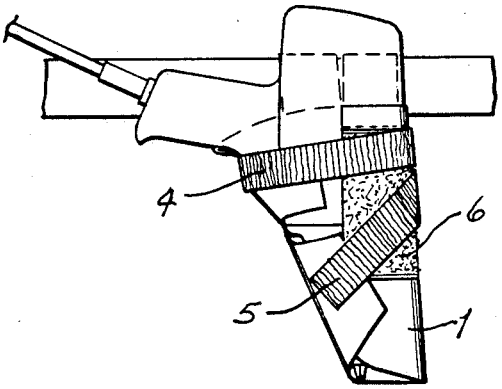
FIG. 6 is a view of the holster hanging from wearer's belt, holding a large heavy, corded power drill.

Referring now to FIG. 6, the holster pocket is now shaped to accommodate a large, heavy, corded power drill; the housing of which remains uniform in width until the chuck end of the tool.

To holster a large pistol type object constructed in such a manner that the housing expands continuously from its trigger area to its use end, the user simply adjusts the lower adjustable strap 10 to create an internal pocket circumference sufficiently small to disallow the use end to pass through lower opening of holster. The upper adjustable strap 4 is then placed in such a manner as to securely retain pistol.

In this usage, the internal shape of the holster pocket is approximately an elliptical cone in which the circumference of the lower circle is larger than that of the upper circle. The boning material 7 entrapped in top seam of sheet material exerts a widening force so as to make the upper opening of the holster generally round. This boning material is affixed in one location approximately at the center of the top seam and travels slightly within the top seam as the top seam is wrapped around the pistol type object.

While the boning material works to keep the upper opening generally round, the compression of double loops 2 and 3 against the users body by worn belt, creates an ultimately oval like shape. This shape is conducive to easy removal and insertion of pistol type object.

Pistol type object may then be removed and reinserted continuously without re-adjustment for the great majority of pistols that use a holster pocket which narrows towards the lower end of its elliptical cone. Holster is then so adjusted as to allow user to engage in generally vigorous activity without loss of pistol from holster.

This pistol type object will remain balanced in holster as a consequence of the presence of double belt loops 2 and 3.

Holster claimed may also secure handgun firearms.

Use of heat resistant materials in construction of holster would allow for the holstering of heatguns. Towards this end a stiff bracket, acting as a spacer, may be affixed horizontally or vertically across that portion of the holster that contacts the leg or hip of user.

Additional costruction materials may be added to sheet material to create small pouches and hold down devices to allow for the storage of pistol type object attachments to enhance use of pistol.

The sheet material may be cut to allow for holster to hang from either side of the body.

Additional adjustable straps on sheet material may be utilized while continuing to create a holster pocket that is shaped approximately as an elliptical cone.

Adjustable straps with mechanical fasteners used exclusively or in combination with "Velcro" type fasteners may be used. These mechanical fasteners may allow for discrete or continuous adjustment settings.

CONCLUSION, RAMIFICATIONS AND SCOPE OF INVENTION

Thus it is apparent that holster disclosed herein has exceptional versatility with regard to size, shape and weight of pistol to be holstered. The preferred embodiment is strong, durable and inexpensive.

My above detailed description contains many specifications, yet should not be understood as limitations on the scope of the invention. Many other embodiments are possible. For example, a tool or device much larger than would normally be termed a pistol type object may be secured in a holstering device that while essentially the same holster described herein, utilizes additional flaps and straps to secure said object within an adjustable elliptical cone.

An additional strap over the top of the holster may be employed to more firmly secure pistol type object for activity that is more than generally vigorous.

REFERENCE NUMERALS FOR FIGURES

1. Flexible Sheet Material
2. Belt Loop Webbing A
3. Belt Loop Webbing B
4. Upper Adjustable Strap Webbing
5. Lower Adjustable Strap Webbing
6. Pile Fabric
7. Boning Material
8. Single Boning Fastener
9. Upper Adjustment Flap
10. Lower Adjustment Flap
11. Upper Adjustable Strap Hook Material
12. Lower Adjustable Strap Hook Material
13. Upper Adjustment Flap Hook Material
14. Sheet Material Edge
15. Lower Adjustable Strap Webbing Reinforcement

I claim:

1. A holster for holding an object comprising:

a piece of flexible sheet material having a top, bottom and two sides;

a plurality of protruding flaps formed as part of said sheet material and extending outwardly from one of said two sides;

said plurality of protruding flaps including at least an upper protruding flap and a lower protruding flap;

a plurality of adjustable straps to individually correspond with each said protruding flap, said straps being attached to said flaps and extending in the same general direction as said flaps, said straps having a portion extending beyond said flap and having a first releasable securing means on said portion;

said plurality of adjustable straps including at least an upper adjustable strap and a lower adjustable strap;

second releasable securing means attached to the other side of said sheet material;

means attached to said sheet material for supporting the holster on a user;

whereby said sheet material is adapted to be generally planar until said sheet material is wrapped around said object and said flaps are individually adjusted around the object and secured to the other side by connection of said first and second securing means thereby forming a pocket for the object.

2. In combination with claim 1 said holster maintaining a substantially circular top opening while said first releasable securing means of said upper adjustable strap connects with said second releasable securing means as a consequence of a band of flexibly resilient material affixed to the top of said sheet material.

3. In combination with claim 1 said adjustable straps, in combination with said sheet material and said first and second securing means, used as a means to create holster pockets, the larger opening of which may be formed at said top or said bottom of said sheet material.

* * * * *